United States Patent [19]

Baumgartner et al.

[11] 4,117,612

[45] Oct. 3, 1978

[54] SMOOTHING OR PRESSING IRON

[76] Inventors: Erich Rudolf Baumgartner, Tiroler Platz 4; Peter Doehler, Kaulbachstrasse 59, both of Munich, Fed. Rep. of Germany

[21] Appl. No.: 773,252

[22] Filed: Mar. 1, 1977

[30] Foreign Application Priority Data

Mar. 2, 1976 [DE] Fed. Rep. of Germany ..... 2608500

[51] Int. Cl.[2] ..... D06F 75/34

[52] U.S. Cl. ..... 38/91

[58] Field of Search ..... 38/88, 89, 91

[56] References Cited

U.S. PATENT DOCUMENTS

| | | | |
|---|---|---|---|
| 74,372 | 2/1868 | Jones | 38/92 |
| 2,262,682 | 11/1941 | Hoffman | 38/91 X |

FOREIGN PATENT DOCUMENTS

| | | | |
|---|---|---|---|
| 657,883 | 9/1951 | United Kingdom | 38/91 |

*Primary Examiner*—Patrick D. Lawson

*Attorney, Agent, or Firm*—Griffin, Branigan and Butler

[57] ABSTRACT

A pressing iron comprises basically a sole-body, housing halves, a clamping device and a circuit support plate. Inclined surfaces on the sole-body and the housing halves cooperate to hold all of the members together when the housing halves are clamped together by the clamping device. Additional features are disclosed for providing an improved pressing iron.

16 Claims, 9 Drawing Figures

SMOOTHING OR PRESSING IRON

Figure 1:
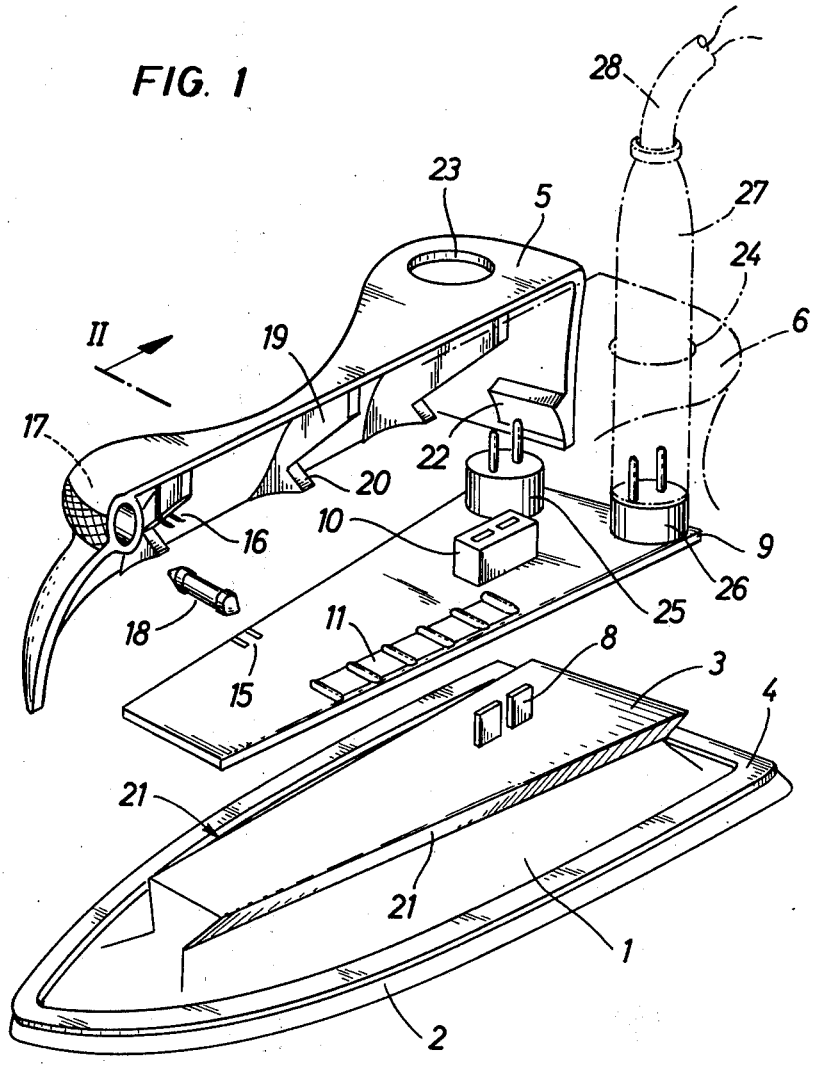

This invention relates to a smoothing or pressing iron comprising a sole-body containing heating means and a housing clamped together with this body. In a pressing iron e.g. described in German Pat. No. 841,741, of a known type, stay bolts project up from a sole-plate while a hood-like housing is put over and around said bolts so that the upper ends of the bolts protrude through bores in said housing to permit one to screw down fastening nuts upon said housing.

This structure of a pressing iron presupposes a very form-stable housing shell because the connection to the sole-body is provided at a few points only. Moreover in modern flat irons provided with control circuits for heating means, all structural components must be ready-assembled over the sole-plate and secured to the latter prior to donning the housing hood whereby the assembly is rendered difficult and requires a series of working steps.

The object of the invention is to solve the problem of designing an electric pressing iron of the above type so that the assembling can be achieved substantially in one single working cycle even though, for fulfilling a plurality of functions, a plurality of individual members are provided which are to be connected to, or secured to, each other.

According to the invention, this problem is solved in that a sole-body comprises inclined surfaces which extend opposite each other and downwardy and respectively inwards with respect to each position in use a housing consists of two housing halves which, on the inner side thereof, have inclined surfaces associated with the first-mentioned inclined surfaces. A clamping device is provided by which said housing halves are clamped together, with said inclined surfaces of said housing halves moving toward each other and tightening said sole-body against said housing halves via the inclined surfaces of said sole-body.

It is to be noted explicitly that said inclined surfaces can be replaced by peg-like projections adapted to be pressed into engagement with inclined surfaces or with guide slide surfaces. Or, vice-versa, inclined surfaces can be pushed in a wedgelike manner under peg-like projections projecting to one side. However cooperating inclined surfaces on the housing halves for one thing and on the sole-body for another thing are preferable because the force produced by the clamping of the housing halves together with each other can be transformed, with peak efficiency, into a force urging the solebody against the housing halves and into engagement therewith.

Preferably said housing halves have ribs which each extend from a housing shell towards the dividing joint and on which the inclined surfaces cooperating with the inclined surfaces of said sole-body are provided. Said dividing joint between said housing halves extends in particular in the longitudinal direction of the pressing iron while the inclined surfaces of said sole-body are formed on a web or ridge which also extends in the longitudinal direction of said iron and which is dovetail-shaped in cross-section. Said web or ridge constitutes not only a mounting element for said sole-body, but also a reinforcing rib imparting considerable bending strength to said sole-body as is advantageous especially when said sole-body is otherwise very thin and made of glass, glass ceramics or refractory plastics, the latter features being of inventive significance independent from the construction specified above.

Advantageous embodiments and further developments are subject matter of the attached claims to which reference is here made for the sake of simplification and reduction of the description.

Figure 2:
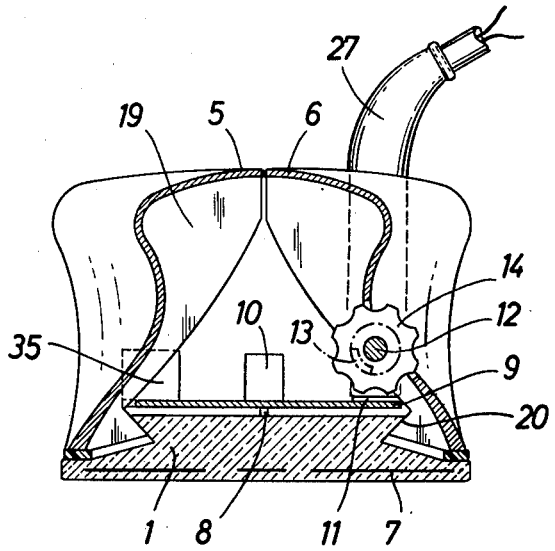
Figure 3:
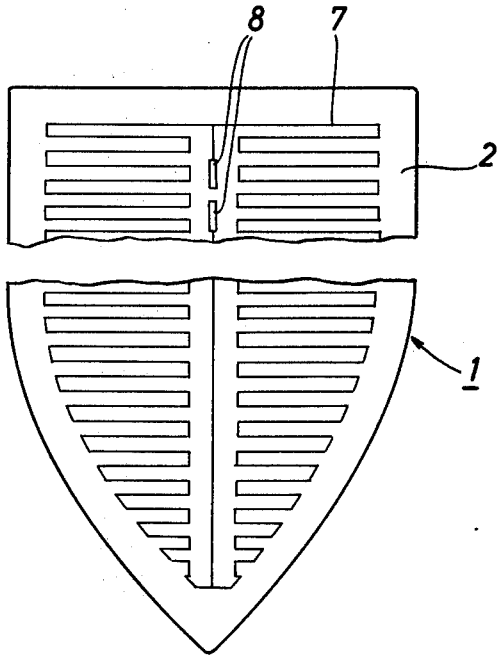
Figure 4:
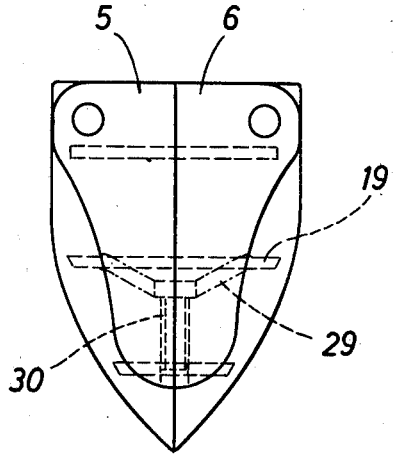
Figure 5:
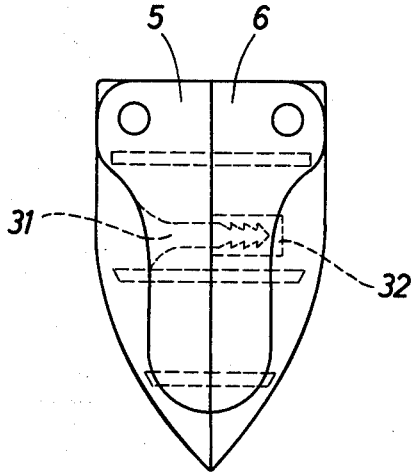
Figure 6:
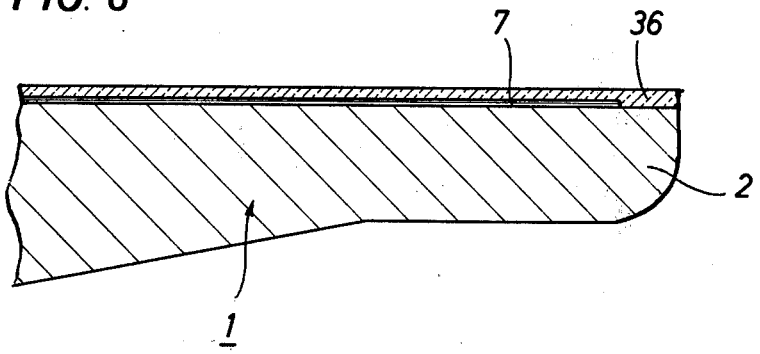
Figure 7:
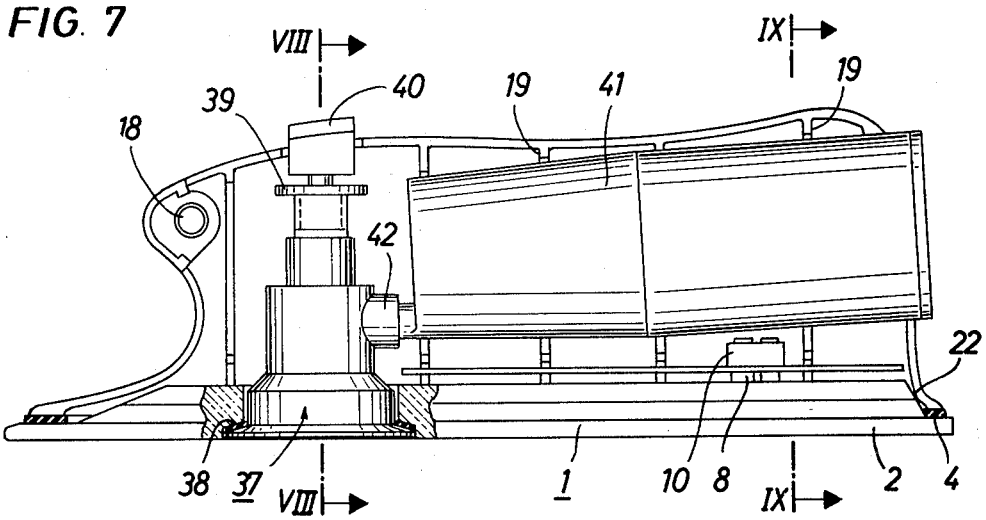
Figure 8:
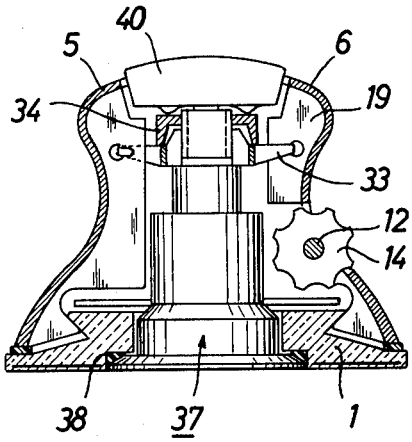
Figure 9:
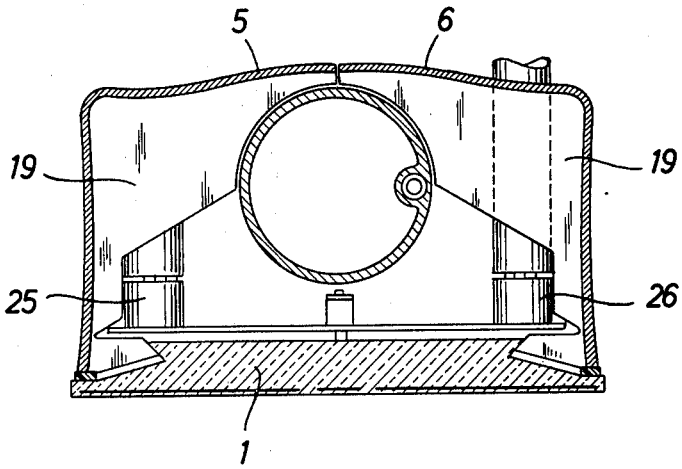

A number of exemplary embodiments are elucidated hereinafter in greater detail with reference to the attached drawings in which FIG. 1 shows a perspective view of a disassembled flat iron with the parts being broken away, FIG. 2 shows a cross-sectional view of said iron according to FIG. 1 and the sectional plane II shown therein, FIG. 3 shows a bottom plan view of the sole-body wherein the sole-layer is removed, FIG. 4 shows a schematical top plan view of the flat iron of FIG. 1 together with clamping means indicated by broken lines, FIG. 5 shows another schematical plan top view of a flat iron according to FIG. 1 together with another embodiment of the clamping means, FIG. 6 shows a partial cros-sectional view of the sole-body having its sole-surface turned upwards, FIG. 7 shows a vertical longitudinal view of still another embodiment of a flat iron, FIG. 8 shows a sectional view of the flat iron of FIG. 7 according to sectional line VIII—VIII therein, and FIG. 9 shows a further cross-sectional view of the flat iron of FIG. 7 according to sectional plane IX—IX therein.

The flat or smoothing iron shown in FIG. 1 has a sole-body 1 of ceramicized glass. From the sole-plate 2 of said sole-body projects up a web or ridge 3 which is dovetail-shaped in cross-section and which, as shown in FIG. 1, tapers from the rear end to the tip of said sole-body. Along the outer edge of the soleplate 2 is provided a resilient connecting seal 4 made of heat-resistant sealing material which, after said sole-body 1 has been clamped together with the housing consisting of two halves 5 and 6, provides a tight connection to the housing.

In the interior of said sole-body 1 are provided meandering heating conductors 7 embedded into said sole-body adjacent its lower surface as shown in FIGS. 2 and 3 whereto, however, reference will be made hereinafter in greater detail.

Said heating conductors 7 are in communication with contact lugs 8 projecting at the top from web 3 of the sole-body 1. FIG. 1 shows two such contact lugs, yet also more such lugs may be provided.

FIG. 2 shows that directly over the surface of web 3 of solebody 1 is placed a circuit support plate 9 on which circuits are provided for controlling or regulating the heating performance and optionally for controlling predetermined functions of the flat iron in the form of printed circuits. Over suitable perforations in the curcuit support plate 9 is furthermore secured a contact socket 10 to said circuit support plate for receiving said contact lugs 8 when said circuit support plate 9 is downwards urged against said sole-body 1 so that via said contact lugs 8 and said contact socket 10 the heating conductors 7 come into communication with the switching circuits of said circuit support plate 9.

On said circuit support plate 9 is furthermore provided a series of array of reed contacts 11 which are a component of the control circuits of said circuit supports plate 9 and cause a predetermined heating power of the heating conductors 7 in response to the respective mode of switching. Directly above said array of reed contacts and parallel to the array of contacts is mounted a shaft 12 in the housing half 6. On said shaft 12 are mounted a plurality of permanent magnets 13 the number of which corresponds to the number of reed contacts. Said shaft is rotatable by adjusting wheel 14 so that in response to each respective position of rotation of adjusting wheel 14 some predetermined ones of said permanent magnets 13 will come into interaction with the associated reed contacts 11 whereby the heating power can be adjusted sensitively in a closely stepped manner. On said circuit support plate 9 are furthermore provided contacts 15 which, in the assembled condition of said flat iron will come into contact with contact springs 16 of housing half 5 so that an illuminating means provided within the front portion of the housing will be imparted an electrical connection to the voltage-carrying members of the switching or control circuits of said circuit support plate 9. In detail, in each of housing halves 5 and 6 is cast-in a socket 17 receiving one end of a small lamp 18. The front end face portion of housing halves 5 and 6 is formed in the shape of a window so that light of lamp 18 is directed obliquely downwards to the area to be worked with said iron. Simultaneously with the clamping of housing halves 5 and 6 together with each other also lamp 18 will be clamped in between sockets 17 whereby contact between contact springs 16 and contact members 17 is established.

The housing shells of housing halves 5 and 6 have ribs 19 whereon inclined surfaces 20 are provided. These inclined surfaces 20 will, during clamping said housing halves together, engage under correspondingly directed inclined surfaces 21 of said web or ridge 3, shaped as dovetail in cross-section, of said sole-body 1, as shown in detail in FIGS. 2, 8 and 9. When said housing halves are clamped together with said sole-body 1 then a further inclined surface 22 at the rear end of said housing halves 5 and 6 is urged against the rear end of said sole-body 1 so that web or ridge 3 which tapers forwardly is pushed in a wedge-like manner in between said ribs 19 of said housing toward the tip or front end of said flat iron.

Beneath perforations 23 and 24 in housing halves 5 and 6 are provided contact plugs 25 and 26 which are secured to the upper side of said circuit support plate 9 and the contact pins of which are in connection with the control circuits of said circuit suppert plate 9. The contact plugs 25 and 26 can be brought into connection with an electric network via a contact coupling 27 pushed into one of perforations 23 or 24 and via a conductor cable 28. It will be apparent that the pressing iron proposed herewith is selectively adapted for use by right-handers and by left-handers in equal manner. That is the housing shown here, and formed integral with the handle, is equally adapted for use by right and left-handers. Also, the cable connection is established selectively either via perforation 23 in the right-hand housing half or via perforation 24 in the left-hand housing half whereas the free, unoccupied perforation is closed by a filler piece which engages with the contact plug located thereunder to efficiently prevent one housing half from being disassembled whilst the pressing iron is not yet separated from the electrical network.

The clamping of housing halves 5 and 6 together can take place by screw anchors extending in the transverse direction. Another possibility is shown in FIG. 4. Here in perforations or openings in ribs 19 there are hung-in knuckle arms 29 which are interconnected in a knuckle-joint like manner and adapted to be clamped by a turnbuckle or coupling nut 30 extending towards the end face end of the housing so that considerable gripping forces can be produced. Yet it is also possible to compress said housing halves 5 and 6 together by external forces in that a spigot 31 provided with barbed hooks and formed in one of said housing halves is forced into a correspondingly formed plug-in socket 32 of the other housing half so that after the housing halves have been pressed together and after the sole-body has been firmly clamped then the spigot 31 holds these structural members together. Furthermore there is a possibility that at openings of said ribs 19 of said housing halves 5 and 6 there should be hung-in hook elements 33 which on the other side each encroach viz. engage about a frusto-conical structural member protruding up from the sole-body 1 and which are urged downwards over this frusto-conical structural member by a spigot or capped nut 34 to thereby tighten the housing halves to each other.

At ribs 19 it is possible that in addition to said inclined surfaces 20 cooperating with the inclined surfaces 21 of web 3 of said sole-body 1 there should also be provided holding inclined surfaces 35 inclined in opposite inclinations, as shown in FIG. 2 of the drawings. As the housing halves 5 and 6 are being clamped together, said holding inclined surfaces cause the circuit support plate 9 to be downwardly urged against the upper side of web 3 of said sole-body 1 whereby said contact lugs 8 are securely held engaged with contact socket 10. Also, said holding inclined surfaces 35 are effective in that when said coupling 27 is being drawn off then the associated plug 25 and 26 respectively is prevented from being drawn up together with said circuit support plate 9.

As already mentioned before, said sole-body 1 consists of an electrically insulating material having a comparatively low thermal conductivity and in particular of glass or vitreous ceramics or of a heat-resistant synthetic material. On the underside of the sole-body — upwardly turned according to FIG. 6 — are located heating conductors 7 which are formed in that either a heating conductor pattern is applied according to the screen printing method and galvanized so as to have the desired thickness or a foil stamped blank is secured. In the latter case, when the sole-body 1 consists of vitreous ceramics, said foil blank is secured by glass solder. The sole-layer 36 with which then said heating conductors 7 are coated consists in turn either of heat-resistant plastics or of glass joined with said sole-body by glass solder, or likewise of vitreous ceramics.

At variance from the above described mode of manufacturing it is possible when the sole-layer 36 has a somewhat greater thickness to use this layer initially as a support for the heating conductors 7 so that for example a heating conductor pattern can be imprinted on the sole-layer 36 and galvanized thereon, whereupon the sole-plate 2 of the sole-body 1 is attached, joined e.g. with the aid of glass solder or cemented thereat.

In any case, the heat conductivity properties of the sole-body 1 cause a preferred heat efflux from the heating conductors 7 to the sole-surface as well as a good insulation of the housing 5, 6 from the hot zones of the sole-body merely by interposing the relatively narrow seal 4.

It is self-evident that the heating means located directly underneath the sole-surface must provide a spatially and timely sufficiently uniform heating-up of the sole-surface of the flat iron without interposing thermal capacitances for rendering eventual variations uniform. To this end, a very rapid and sensitive regulation or control is required, yet it is not difficult to arrange the requisite control circuits on the circuit support plate 9 as a printed electronic circuitry.

The embodiment according to FIGS. 7 to 9 differs from the above described embodiments in that additionally an evaporator means is provided which comprises an evaporator unit 37 projecting up substantially normal to the sole-plate 2. The evaporator unit 37 extends through an opening of sole-body 1 in the manner shown in FIGS. 7 to 9 and terminates at the bottom flush with the sole-surface. A sealing ring 38 provides a fluidtight seal between the sole-body 1 and the evaporator unit 37. The evaporator unit contains a (not shown) evaporator heating means in communication with the control circuits of the circuit support plate 9 via (not shown) connecting means so as to receive electrical power via cable 28. At the upper end of the evaporator unit 37 is provided a valve arrangement 39 adapted to be actuated by manual switch 40 so that vapour or steam can be selectively caused to flow out at the underside of the pressing iron. Adjacent the upper end of the evaporator unit 37 is located also said conical structural member which was mentioned hereinbefore in conjunction with FIG. 8 and which cooperates with said hook elements 33 to be thereby capable of tightening the housing halves 5 and 6 by screwing down said spigot or capped nut 34, in this embodiment of the flat iron.

A water tank 41 extends in the longitudinal direction through the inner space of the housing and is in communication with said evaporator unit 37 via a connecting nipple 42. The water tank 41 can be pushed into the flat iron via a rear opening of housing halves 5 and 6 while valve means within the range of the connecting nipple 42 prevent water from flowing off during insertion or withdrawal of the water tank. In the here described embodiment, at least a few of said ribs 19 are provided with recesses corresponding to the contour of the water tank 41 so that the ribs support and hold said water tank 41.

We claim:

1. A smoothing or pressing iron comprising a sole-body including a heating means for applying heat, a housing clamped to said sole-body, and a clamping means, said sole-body further comprising a first set of inclined surfaces located on opposite sides of said sole-body extending downwardly and converging inwardly with respect to the normal position of the iron when in use, said housing comprising two housing halves which, on the inner sides thereof, have a second set of inclined surfaces for cooperating with said first set of inclined surfaces, said clamping means engaging said housing halves for clamping said housing halves together to urge said second set of said inclined surfaces of said housing inwardly against said first set of said inclined surfaces of said sole-body to thereby grip said sole-body with said housing halves via said inclined surfaces.

2. The smoothing or pressing iron according to claim 1, characterized in that said housing halves have housing ribs which each extend laterally from the housing shell in the direction of a dividing interface between said housing halves and on which the second set of inclined surfaces are formed.

3. The smoothing or pressing iron according to claim 1, characterized in that a dividing interface between said housing halves extends in the longitudinal direction of the pressing iron, and in that the inclined surfaces of said sole-body are formed on a sole-body web or ridge which also extends in the longitudinal direction of said iron and which is dovetail-shaped in cross-section.

4. The smoothing or pressing iron according to claim 3, characterized in that said sole-body web or ridge tapers in cross-section toward the tip or front end of said smoothing iron, and in that said housing halves have their rear end provided with further inclined surfaces so that when said housing halves and said sole-body are clamped together said further inclined surfaces urge said sole-body relative to said housing halves in the direction of the tip or front end of said smoothing iron.

5. The smoothing or pressing iron according to claim 1, characterized in that contact lugs of the heating means protrude upwardly from said sole-body, said pressing iron further comprising a circuit support plate including a contact socket for engaging said upwardly-protruding contact lugs, said housing halves further including a third set of inclined surfaces having an inclination opposite to the inclination of the second set of inclined surfaces for urging said circuit support plate against said sole-body and holding said contact socket over and around said contact lugs when said housing halves are clamped against each other.

6. The smoothing or pressing iron according to claim 5, characterized in that said circuit support plate includes contact plugs on its upper side, and each of said housing halves defines one opening located above a respective one of said contact plugs to allow a contact coupling to be introduced via said opening and connected to said contact plug of said circuit support plate.

7. The smoothing or pressing iron according to claim 5, characterized in that said circuit support plate includes reed contacts and control circuits of said heating means, and said pressing iron further comprises permanent magnets adjacent to said reed contacts, said permanent magnets being rotatably arranged on a shaft which is journaled in at least one housing half and is coupled to an adjusting wheel accessible via an opening on said housing.

8. The smoothing or pressing iron according to claim 1, characterized in that said housing halves are held together by way of a spigot or plug provided with barbed hooks on one half and a plug-in socket on the other half into which said spigot or plug is pushed so that said spigot or plug and said plug-in socket are locked with each other.

9. The smoothing or pressing iron according to claim 1, characterized in that said housing halves are held together by two knuckle arms which are connected to the halves and to each other and a turnbuckle attached to a knuckle-joint between the knuckle arms for urging the halves together.

10. The smoothing or pressing iron according to claim 1, characterized in that said housing halves are held together by hook elements adapted to be shifted along wedge surfaces to thereby clamp said housing halves together.

11. The smoothing or pressing iron according to claim 2, characterized in that said ribs have recesses for receiving a liquid container and said iron includes a liquid container, an evaporator and a connecting nipple, said liquid container being adapted to be pushed into said housing via a housing opening and to be inserted, by means of said connecting nipple, to said evaporator at an opening in said evaporator, said evaporator projecting upwardly from the bottom surface of said sole-body into an interior space defined by said housing.

12. The smoothing or pressing iron according to claim 1, characterized in that between said sole-body and said housing halves is disposed a resilient heat-insulating seal extending along and around the edge of said sole-body.

13. The smoothing or pressing iron, according to claim 1, characterized in that said sole-body is one integrally formed piece and said heating means are embedded therein.

14. The smoothing or pressing iron, according to claim 1, characterized in that heating means are arranged between a sole-plate of one material of the sole-body and a surface sole-layer of another material.

15. The smoothing or pressing iron according to claim 13, characterized in that said sole-body consists of glass or glass ceramics.

16. The smoothing or pressing iron according to claim 13, characterized in that said sole-body consists of a heat-resistant synthetic material.

* * * * *